US008951023B2

(12) United States Patent
O'Connor

(10) Patent No.: US 8,951,023 B2
(45) Date of Patent: Feb. 10, 2015

(54) PUMP SYSTEM

(75) Inventor: Donald Michael O'Connor, Sandton (ZA)

(73) Assignee: Stratabolt (Proprietary) Limited, Islando, Gauteng (ZA)

( * ) Notice: Subject to any disclaimer, the term of this patent is extended or adjusted under 35 U.S.C. 154(b) by 406 days.

(21) Appl. No.: 12/800,106

(22) Filed: May 7, 2010

(65) Prior Publication Data

US 2010/0266421 A1 Oct. 21, 2010

Related U.S. Application Data

(63) Continuation of application No. 12/587,811, filed on Oct. 14, 2009, now abandoned.

(30) Foreign Application Priority Data

Apr. 14, 2007 (GB) ..... 0707220.0

(51) Int. Cl.

| | |
|---|---|
| ***F04B 45/053*** | (2006.01) |
| ***F04B 43/073*** | (2006.01) |
| ***F04B 23/06*** | (2006.01) |
| ***F04B 15/02*** | (2006.01) |
| ***F04B 43/06*** | (2006.01) |
| ***F04B 49/06*** | (2006.01) |
| ***F04B 43/02*** | (2006.01) |

(52) U.S. Cl.

CPC ..... *F04B 43/06* (2013.01); *F04B 15/02* (2013.01); *F04B 49/06* (2013.01); *F04B 43/025* (2013.01)

USPC ..... 417/216; 417/395; 417/426; 436/180; 422/509

(58) Field of Classification Search

CPC ..... F04B 43/06; F04B 49/06; F04B 43/025; F04B 15/02

USPC ..... 417/216, 395, 426, 521, 533, 46, 53; 436/55, 180; 422/63, 67, 501, 509; 222/135, 255, 263, 334

See application file for complete search history.

(56) References Cited

U.S. PATENT DOCUMENTS

| | | | | |
|---|---|---|---|---|
| 4,490,096 A | | 12/1984 | Box | 417/342 |
| 4,543,044 A | * | 9/1985 | Simmons | 417/342 |
| 5,141,408 A | | 8/1992 | Conrad et al. | 417/339 |
| 5,158,210 A | * | 10/1992 | Du | 222/134 |
| 5,167,837 A | | 12/1992 | Snodgrass et al. | 210/767 |
| 8,096,785 B2 | * | 1/2012 | Eysymontt | 417/395 |

FOREIGN PATENT DOCUMENTS

| | | | | |
|---|---|---|---|---|
| EP | 0903496 | | 3/1999 | F04B 43/00 |
| WO | WO2005119063 | * | 12/2005 | F04B 43/11 |

* cited by examiner

*Primary Examiner* — Bryan Lettman
(74) *Attorney, Agent, or Firm* — Nixon & Vanderhye P.C.

(57) ABSTRACT

Pumping systems and methods for delivering a plurality of different pumpable materials serially at a location at substantially the same flow rate includes a plurality of diaphragm pumps, wherein each diaphragm pump has a first chamber for receiving a hydraulic fluid from a first and/or second hydraulic fluid source and a second chamber for receiving a material to be pumped from one of a plurality of pumpable material sources. A sensor is provided for detecting the pressure of the hydraulic fluid in each of the first chambers of the plurality of diaphragm pumps and is operable to activate the source of hydraulic fluid to ensure that the hydraulic fluid in each of the first chambers of the plurality of diaphragm pumps has an equivalent pressure.

19 Claims, 1 Drawing Sheet

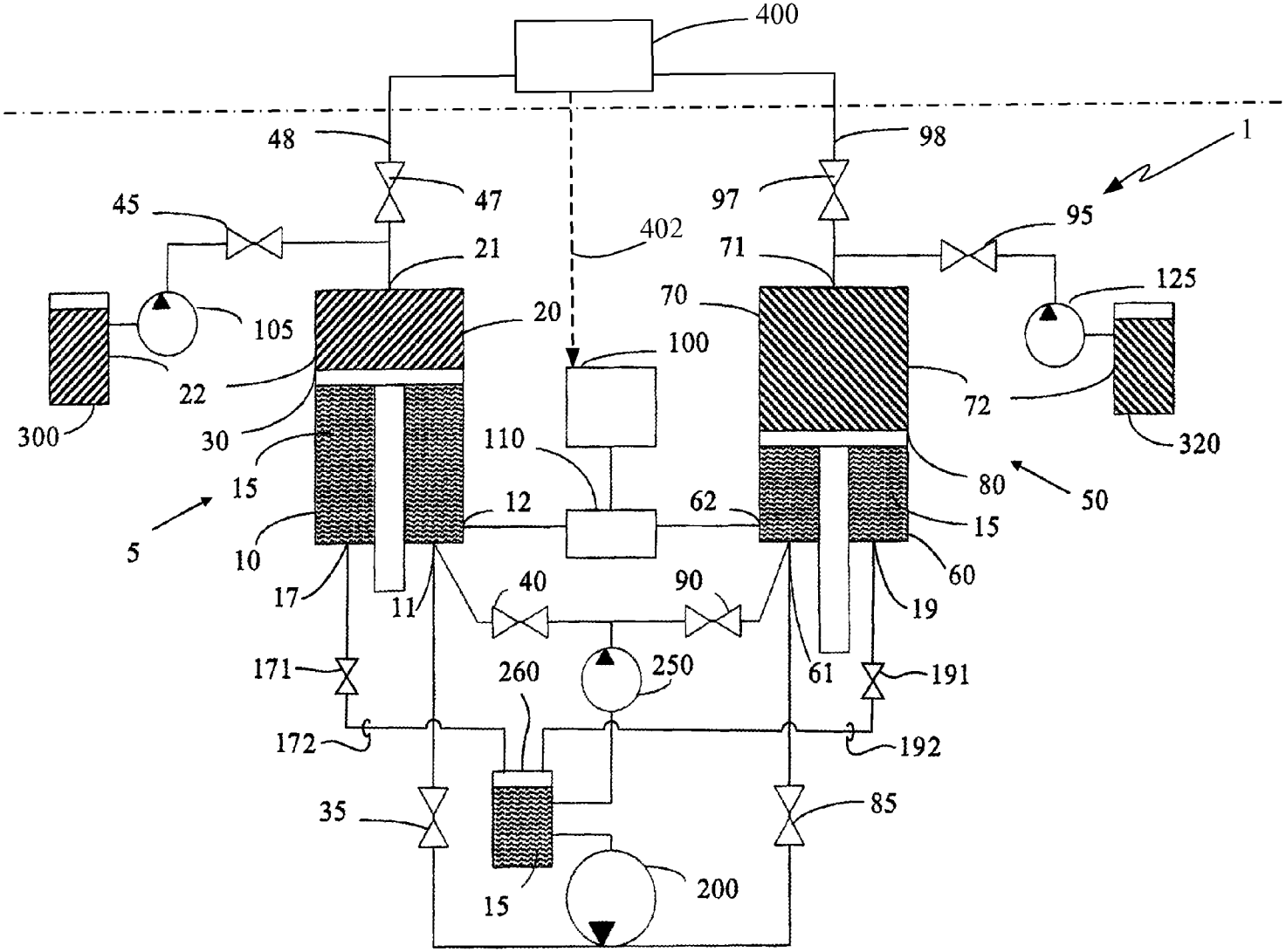
1
125
320
95
50
72
80
15
60
98
191
192
19
85
400
97
71
61
70
62
90
200
100
402
250
110
12
40
260
15
20
47
21
11
48
17
171
172
35
105
22
30
15
10
45
5
300

PUMP SYSTEM

RELATED APPLICATION DATA

This application is a continuation of application Ser. No. 12/587,811 filed Oct. 14, 2009 (now abandoned), which in turn is a continuation of and is based on PCT Application No. PCT/IB2008/051377 filed Apr. 11, 2008 which designated the U.S. and claims priority from GB Patent Application No. 0707220.0 filed Apr. 14, 2007.

BACKGROUND OF THE INVENTION

1. Field of the Invention

The present invention provides a pump for delivering two different materials serially at a location at substantially the same flow rate and pressure. The pump is useful for consistently filling capsules with two different materials such that the internal pressure of the capsules is substantially uniform.

A resin capsule is commonly used for securing a bolt into a rock face to support the rock face, e.g, in a rock tunnel in a mine. A resin capsule generally comprises a tubular sheath of a frangible film, with a longitudinal barrier dividing the capsule into two compartments. The capsule is terminated by clips. Within the capsule, one compartment is filled with a mastic of polyester resin and fillers (usually limestone) and the other compartment is filled with a paste containing activator for the polyester resin, extended with fillers such as further limestone and water. The capsule typically has a diameter of 12-40 mm and a length of 300-3000 mm.

Resin capsules are manufactured continuously on "form-fill-seal" machinery. There are many variants of this machinery. Generally, the sheath is first formed by folding a web of film into a tube and continuously forming longitudinal seals and the internal barrier as the tube travels through the machine. At a short distance after the formation of the tube, nozzles inject the resin mastic and activator paste into their respective compartments. At later stages the terminating clips are affixed and the tube is severed between clips to form the discrete capsules. Typical output of such a machine is 12-25 meters of resin capsules per minute.

Customer requirements are that the capsules should have consistent mass, consistent internal pressure and consistent proportion between resin and activator components. These requirements are met by ensuring constant flow rates and pressures from the nozzles injecting the resin and activator components.

In resin-grouted rock bolting practice, there is commonly a requirement that two setting times of resin be used: a fast-set resin at the distal end of the rock bolt hole, and a slow-set resin nearer the collar. Use of the fast-slow combination makes installation of the bolt easier in holes more than about 1.5 m deep.

Various methods are used to place the two setting times of resin in the hole. The simplest is for the operator to separately load discrete capsules, the first-loaded capsule or capsules containing fast-set resin and the later loaded capsule or capsules containing slow-set resin, This method is slow and prone to operator error however.

A better method is to have the fast and slow resins in the same capsule, which will have one end filled with fast resin mastic and the other with slow resin mastic. Such a capsule is known as a two-speed capsule and is used on a large scale in Australia where capsules are sold under the trade names "TooSpeedie" and "Duospeed". A two-speed capsule is believed to be manufactured by using parallel resin mastic pumping lines for the fast and slow components with the capsule forming machine switching between the two lines. It will be appreciated that delicate balancing of the two lines is necessary to achieve the switch without fluctuation of pressure or flow, and that this balancing must be regularly adjusted as the pumps wear.

2. Description of the Prior Art

Conventionally a pumping system comprising a pair of diaphragm pumps is used to fill normal capsules because it produces a constant flow and pressure. Such a system is described in U.S. Pat. No. 4,543,044. They are generally known as constant-flow diaphragm pumps and will be referred to herein as a CFD pump. The disadvantage of the CFD pump is its high initial cost. Each one is custom-made. The CFD pumping technology cannot be readily applied to the manufacture of two-speed capsules, due to the high capital cost of providing dual parallel CFD pumps.

An advantage of using a CFD pump is that, unlike a conventional progressing cavity pump (such as made by Mono or Moyno), it can be used to pump a mastic containing coarse particles of a filler. Thus a two-speed capsule is more expensive to manufacture by using a conventional progressing cavity pump because it contains more polyester resin and activator. Furthermore, whilst a progressing cavity pump is more readily available and cheaper than a CFD pump, it suffers from the limitations that the rotors and stators wear and need regular replacement; and that as the components wear there is a drift in flow rate and pressure, which makes long-term automatic control difficult.

As an alternative, a different method of achieving the two setting times of resin in the same capsule has been found. This method uses direct injection of an accelerator into a portion of the length of the capsule, in synchronisation with capsule formation. When the capsule is broken and the contents mixed during rock bolt installation, the accelerator mixes with the resin and transforms part of the resin from slow to fast. This method can be used in conjunction with the conventional method of manufacturing normal capsules, i.e. by using a CFD pump and including coarse filler in the capsule. Although the production line is relatively low-cost to build, this method has the disadvantages of reduced shelf-life of the capsules as the accelerator migrates inside the capsule; mixing of the accelerator with the resin in the rock bolt hole is not efficient such that the dosage of accelerator is much higher than in pre-blending fast resin mastic prior to injection; and the accelerator normally used (which is di-methyl paratoluidine) is a high-cost material.

Accordingly improvements in the production of two-speed resin capsules have been sought.

SUMMARY OF THE INVENTION

According to the invention there is provided a pumping system for delivering a plurality of different materials serially at a location at substantially the same flow rate wherein the system has a plurality of diaphragm pumps wherein each diaphragm pump has a first chamber for receiving a hydraulic fluid from a first and/or a second hydraulic fluid source and a second chamber for receiving a material to be pumped from one of a plurality of pumpable material sources and wherein the system has a sensor for detecting the pressure of the hydraulic fluid in each of the first chambers of the plurality of diaphragm pumps which sensor is operably connected to a source of hydraulic fluid such that the sensor can activate a source of hydraulic fluid to ensure that the pressure of the hydraulic fluid in each of the first chambers of the plurality of diaphragm pumps is equivalent at a time when delivery from one of the diaphragm pumps ceases and delivery from another commences.

According to the invention there is also provided a method of delivering a plurality of different materials at a location at substantially the same flow rate which method comprises the steps of:

(a) providing a pumping system having a plurality of diaphragm pumps wherein each diaphragm pump has a first chamber for receiving a hydraulic fluid from a first or a second hydraulic fluid source and a second chamber for receiving a material to be pumped from a plurality of pumpable material sources;

(b) filling a second chamber of a first diaphragm pump with a first pumpable material from a first pumpablc material source;

(c) pumping hydraulic fluid front a first hydraulic fluid source to the first chamber of the first diaphragm pump so that the pumping system provides the first pumpable material at the location, whilst:

(1a) filling the second chamber of a second diaphragm pump with a second pumpable material from a second pumpable material source;

(2a) sensing pressure of the hydraulic fluid in the first chamber of the first diaphragm pump and the pressure of the hydraulic fluid in the first chamber of the second diaphragm pump;

(3a) using the second hydraulic fluid source to adjust the pressure of the hydraulic fluid in the first chamber of the second diaphragm pump such that it has an equivalent pressure to the pressure of the hydraulic fluid in the first chamber of the first diaphragm pump;

(d) stopping pumping of the hydraulic fluid from the first hydraulic fluid source to the first chamber of the first diaphragm pump;

(e) pumping hydraulic fluid from the first hydraulic fluid source to the first chamber of the second diaphragm pump so that the system provides the second pumpable material at the location at substantially the same rate as the first pumpable material, whilst:

(1b) filling the second chamber of the first diaphragm pump with a first pumpable material from a first pumpable material source;

(2b) sensing the pressure of the hydraulic fluid in the first chamber of the first diaphragm pump and the pressure of the hydraulic fluid in the first chamber of the second diaphragm pump;

(3b) using the second hydraulic fluid source to adjust the pressure of the hydraulic fluid in the first chamber of the first diaphragm pump such that it has an equivalent pressure to the pressure of the hydraulic fluid in the first chamber of the second diaphragm pump; and (f) ceasing pumping of the hydraulic fluid from the first hydraulic fluid source to the first chamber of the second diaphragm pump.

The method of the invention optionally additionally includes the step of (g) repeating steps (c) to (f) one or more times.

A hydraulic fluid source for use in the invention is preferably a hydraulic fluid pump connected to a supply of hydraulic fluid. Preferably the first and second hydraulic fluid sources comprises a first and second hydraulic fluid pump which are each connected to a supply of hydraulic fluid. Preferably the first chamber of a diaphragm pump used in the invention has a hydraulic fluid drain connected to the supply of hydraulic fluid. A pumpable material source is preferably a pump (for example a hydraulic pump or a diaphragm pump, especially a compressed air diaphragm pump) connected to a supply of pumpable material.

A diaphragm pump generally has a housing divided by a moveable diaphragm into a first variable-volume chamber for hydraulic fluid and a second variable-volume chamber for pumpable material. The first chamber has an inlet for hydraulic fluid and the second chamber has an outlet for pumpable material. Supply of hydraulic fluid to the first chamber causes the diaphragm to move in the direction of the second chamber such that the pumpable material is pumped out of the outlet of the second chamber.

The system according to the invention preferably has two diaphragm pumps each of which is connected in use to a different source of pumpable material. The system is preferably arranged such that it can be operated continuously. More preferably the system has a controller which in use directs one pump to discharge the pumpable material from its second chamber whilst controlling the filling of the second chamber of the other pump with a different pumpable material.

BRIEF DESCRIPTION OF THE DRAWINGS

The invention is illustrated by way of example with reference to the FIGURE of the accompanying drawings which shows a schematic layout of a pumping system according to the invention.

DETAILED DESCRIPTION OF THE INVENTION

The pumping system 1 shown in the FIGURE has a first diaphragm pump 5, a second diaphragm pump 50, a programmable logic controller (PLC) 100, and a sensor 110. The pumping system 1 is shown in the FIGURE to be connected to a first source of a first pumpable material 300 via first material pump 105 and to a second source of a second pumpable material 320 via second material pump 125. The pumping system 1 is also shown in the FIGURE to be connected to a first hydraulic pump 200 and to a second hydraulic pump 250. The first diaphragm pump 5 has a first chamber 10 which is filled with hydraulic fluid 15, a second chamber 20 which is filled with a first pumpable material 22 and a diaphragm 30 which separates the first chamber 10 from the second chamber 20. The first chamber 10 has a port 11 which is connected to the first hydraulic pump 200 via a valve 35. Port 11 of the first chamber 10 is also connected to the second hydraulic pump 250 via a valve 40 (as an alternative, the first chamber 10 of the first hydraulic pump 5 may be provided with a further port to which the second hydraulic pump 250 may be connected via the valve 40). The first chamber 10 also has a sensor port 12 and a drain port 17. The second chamber 20 has a port 21 which is connected to the first material pump via first material valve 45. Where the pumping system 1 is used to fill a resin capsule, the volume of the second chamber 20 is sufficient to deliver enough of the first material to fill its respective portion of a resin capsule. Port 21 of the second chamber 20 is also connected to an outlet 48 via outlet valve 47. Diaphragm pump 50 has a first chamber 60 which is filled with hydraulic fluid 15, a second chamber 70 which is filled with a second pumpable material 72 and a diaphragm 80 which separates the first chamber 60 from the second chamber 70. The first chamber 60 has a port 61 which is connected to the first hydraulic pump 200 via a valve 85. Port 61 of the first chamber 60 of second diaphragm pump 50 is also connected to the second hydraulic pump 250 via a valve 90 (as an alternative, the first chamber 60 of the second hydraulic pump 50 may be provided with a further port to which the second hydraulic pump 250 may be connected via the valve 90). The first chamber 60 also has a sensor port 62 and a drain port 19. The second chamber 70 has a port 71 which is connected to the second material pump 125 via second material valve 95. Where the pumping system 1 is used to fill a resin capsule, the volume of the second chamber 70 is sufficient to deliver enough of the second material to fill its respective portion of a resin capsule. Port 71 of the second chamber 70 is also connected to an outlet 98 via outlet valve 97. Like outlet 48, outlet 98 may be connected to a packaging machine 400, eg for resin capsules. Again, for convenience, the outlet valve 97 may be located close to the packaging machine 400.

First material pump 105 is connected to a supply 300 of first pumpable material 22. Second material pump 125 is connected to a supply 320 of second pumpable material 72. First and second material pumps 105, 125 are in the form of conventional compressed air operated diaphragm pumps. As an alternative, material pumps 105, 125 may be close coupled low-pressure diaphragm pumps powered by a pressure accumulator where rapid pumping of first and second pumpable material is required. By close coupled is meant that the length of the connection between diaphragm pumps 5, 50 and material pumps 105, 125 is minimised. As a further alternative, the functions of first and second material pumps 105, 125 may be performed by first hydraulic pump 200. The advantage of this embodiment is that the PLC 100 does not need to coordinate the activity of the first and second material pumps 105, 125, simplifying the PLC 100. In this embodiment, the first hydraulic pump 200 runs continuously supplying hydraulic fluid to either of the first chambers 10, 60 and pumpable material 22, 72 to either of the second chambers 20, 70, first and second hydraulic pumps 200, 250 are connected to a supply 260 of hydraulic fluid 15. The drain ports 17, 19 of the first chambers 10, 60 of the first and second diaphragm pumps 5, 50, respectively, are connected to the supply 260 of hydraulic fluid 15 via drain valves 171, 191 in drain lines 172, 192, respectively.

The second hydraulic pump 250 is an auxiliary hydraulic pump and is run intermittently. As an alternative, the second hydraulic pump 250 comprises a hydraulic accumulator and the second hydraulic pump 250 is run continuously to pressurise the accumulator. The advantage of such an arrangement is that the accumulator will be faster to operate than the second hydraulic pump 250.

In operation, to fill the second chamber of a diaphragm pump with pumpable material, the following procedure is needed. Outlet valve 47, 97 of the diaphragm pump 5, 50 is closed and the first material valve 45, 95 is opened. At the same time, valves 35, 85, 40, 90 are closed and drain valves 171, 191 are opened. Then second chamber 20, 70 of the respective diaphragm pump 5, 50 is fed with pumpable material 22, 72 from supply 300, 320 via material pump 105, 125. In operation, at the start of a cycle, where the second chamber 20 of the first diaphragm pump 5 has been filled with the first pumpable material 22 (which may be for example fast resin mastic) and outlet valve 47 is open and first material valve 45 is closed, the first diaphragm pump 5 will then deliver the first pumpable material 22 to the packaging machine 400 when valve 35 is open, the drain valve 171 of the first chamber 10 and valve 40 are closed and first hydraulic pump is operating to deliver hydraulic fluid 15 from source 260 to the first chamber 10 of first diaphragm pump 5.

The rate of delivery of the first pumpable material 22 to the packaging machine 400 is the same as the rate at which the first hydraulic pump 200 delivers hydraulic fluid 15 to the underside of the diaphragm 30 in first chamber 10 of first diaphragm pump 5. First hydraulic pump does not simultaneously deliver any hydraulic fluid 15 to the first chamber 60 of second diaphragm pump 50.

While the first diaphragm pump 5 is delivering the first pumpable material 22 to the packaging machine 400, the second diaphragm pump 50 is being prepared. The second chamber 70 of the second diaphragm pump 50 is refilled with the second pumpable material 72 (which may be for example slow resin mastic) from supply 320 via second material pump 125. Outlet valve 97 is closed and second material valve 95 is open. At the same time the drain valve 191 of the first chamber 60 is open so that the hydraulic fluid 15 drains from the first chamber 60 into supply 260 as the second pumpable material 72 is pumped into the second chamber 70.

When the second chamber 70 is full, sensor 110 detects this and then causes the PLC to close second material valve 95 and the drain valve 191 of first chamber 60. The sensor 110 activates the second hydraulic pump 250 to re-pressurise the first chamber 60 until the sensor 110 detects that pressures in first chambers 10 and 60 are equivalent. In this example, the first and second materials 22, 72 have the same viscosity, and so an equivalent pressure in each of the first chambers 10, 60 to be detected by the sensor 110 at this stage is an identical pressure.

Where the first and second materials 22, 72 have different viscosities, using an identical pressure will generate different initial flow rates at the outlets 48,98. In order to overcome this problem, two approaches are possible to find an equivalent pressure. Firstly, the pressure in the first chambers 10,60 of each diaphragm pump 5,50 as each diaphragm pump 5,50 is delivering pumpable material 22,72 is measured and stored in the PLC 100 for a given cycle. When the first chambers 10,60 are being re-pressurised for the next cycle, the sensor 110 increases the pressure in the first chambers 10,60 until it is equal to that measured by the sensor 110 and stored in the PLC 100 in the previous cycle. Secondly, a ratio could be used by sensor 110 to calculate the equivalent pressure. The ratio could be set by an operator theoretically, e.g. by basing it on the relative viscosities of the first and second materials 22,72, empirically, e.g. by basing it on the appearance of the packaged first and second materials or by a combined theoretical and empirical approach. As a further alternative, a closed loop control system could he used.

At the time when delivery of the first material 22 should stop and delivery of the second material 72 should commence, the packaging machine 400 generates a signal 402. In order for the pumping system 1 to function properly, the time taken to fill the second chamber 20, 70 of a diaphragm pump 5, 50 with pumpable material 22, 72 and re-pressurise the first chamber 10, 60 should be less than the time taken to deliver a sufficient amount of the first or second material 22, 72 to the packaging machine 400.

When the signal 402 is received, PLC 100 closes valve 35 and outlet valve 47 and opens valve 85 and outlet valve 97 so that the first hydraulic pump 200 switches to delivering hydraulic fluid 15 to the first chamber 60 of the second diaphragm pump 50. Second pumpable material 72 is then delivered to the packaging machine 400. The pre-pressurisation of the first chamber 60 of the second diaphragm pump 50 and the fact that delivery of the second material 72 is driven by the same hydraulic pump 200, which runs without interruption, ensures that the switch from the delivery of the first material 22 to delivery of the second material 72 occurs without fluctuation in pressure or flow.

While the second diaphragm pump 50 is delivering the second pumpable material 72 to the packaging machine 400, the first diaphragm pump 5 is being prepared in a similar manner to that used for the second diaphragm pump 50, as described above. The second chamber 20 of the first diaphragm pump 5 is refilled with the first pumpable material 22 from supply 300 via first material pump 105. Outlet valve 47 is closed and first material valve 45 is open. At the same time the drain valve 171 of the first chamber 10 is open so that the hydraulic fluid 15 drains from the first chamber 10 into supply 260 as the first pumpable material 22 is pumped into the second chamber 10. When the second chamber 20 is full, sensor 110 detects this and then causes first material valve 45 to close. The sensor 110 activates the second hydraulic pump 250 to re-pressurise the first chamber 10 until the sensor 110 detects that pressures in first chambers 10 and 60 are equivalent.

At the time when delivery of the second pumpable material 72 should stop for delivery of the first pumpable material 22 to re-commence, the packaging machine 400 again generates a signal 402. At this stage a cycle is completed. The cycle may be repeated for as long as is required.

The invention allows the CFD pump principle to be economically applied to the manufacture of resin capsules containing two speeds of resin mastic. Use of the CFD pump allows the two-speed capsule to utilise coarse filler. The resulting capsule will have the advantages of being produced at a lower cost, having better storage characteristics and being more convenient to use than has been attainable previously.

What is claimed is:

1. A pumping system which delivers a plurality of different pumpable materials serially at a flow rate, wherein the system comprises:

a plurality of diaphragm pumps, wherein each diaphragm pump has a first chamber for receiving a hydraulic fluid from a first and/or a second hydraulic fluid source, a second chamber for receiving a respective one of the pumpable materials to be pumped from one of a plurality of different pumpable material sources, and a port that is connected to the second chamber;

a plurality of outlets, wherein each outlet is connected to the port of a respective one of the diaphragm pumps; and a sensor for detecting the pressure of the hydraulic fluid in each of the first chambers of the plurality of diaphragm pumps, which sensor is operably connected to the first and/or second hydraulic fluid source such that the sensor can activate the first and/or second hydraulic fluid source to ensure that the hydraulic fluid in each of the first chambers of the plurality of diaphragm pumps have equivalent pressures at a time when delivery from one of the diaphragm pumps ceases and delivery from another commences, wherein the different pumpable materials have different viscosities and wherein the equivalent pressures are different such that the pumpable materials are delivered to the respective outlet at the flow rate.

2. The system as recited by claim 1 wherein the first and/or second hydraulic fluid source is a hydraulic fluid pump connected to a supply of hydraulic fluid.

3. The system as recited by claim 1 wherein the first and second hydraulic fluid sources comprise first and second hydraulic fluid pumps each of which is connected to a supply of hydraulic fluid.

4. The system as recited by claim 1 wherein the first chamber of each diaphragm pump has a hydraulic fluid drain which is connected to a supply of hydraulic fluid.

5. The system as recited by claim 1 wherein the first and second chamber of each diaphragm pump is divided by a moveable diaphragm.

6. The system as recited by claim 1 which has two diaphragm pumps, and two pumpable material sources, wherein each diaphragm pump is connected in use to a respective one of the pumpable material sources.

7. The system as recited by claim 1 which is arranged to operate continuously.

8. The system as recited by claim 7 which has a controller which in use directs one pump of the plurality of diaphragm pumps to discharge the pumpable material from its second chamber while controlling the filling of the second chamber of another pump with a different pumpable material.

9. A method of delivering a plurality of different pumpable materials at a flow rate, which method comprises:

(a) providing a pumping system having, (a1) a plurality of diaphragm pumps wherein each diaphragm pump has a first chamber for receiving a hydraulic fluid from a first or a second hydraulic fluid source, a second chamber for receiving a material to be pumped from a plurality of pumpable material sources, and a port that is connected to the second chamber, and (a2) a plurality of outlets, wherein each outlet is connected to the port of a respective one of the diaphragm pumps;

(b) filling the second chamber of a first diaphragm pump with a first of the pumpable materials from a first of the pumpable material sources;

(c) pumping hydraulic fluid from the first hydraulic fluid source to the first chamber of the first diaphragm pump so that the pumping system provides the first pumpable material at a first of the outlets at the flow rate, while (c1) filling the second chamber of a second diaphragm pump with a second of the pumpable materials from a second of the pumpable material sources;

(c2) sensing a pressure of the hydraulic fluid in the first chamber of the first diaphragm pump and a pressure of the hydraulic fluid in the first chamber of the second diaphragm pump;

(c3) using the second hydraulic fluid source to adjust the pressure of the hydraulic fluid in the first chamber of the second diaphragm pump such that it has a first equivalent pressure to the pressure of the hydraulic fluid in the first chamber of the first diaphragm pump;

(d) stopping pumping of the hydraulic fluid from the first hydraulic fluid source to the first chamber of the first diaphragm pump;

(e) pumping hydraulic fluid from the first hydraulic fluid source to the first chamber of the second diaphragm pump so that the system provides the second pumpable material at a second of the outlets at the flow rate, while (e1) filling the second chamber of the first diaphragm pump with the first pumpable material from the first pumpable material source;

(e2) sensing the pressure of the hydraulic fluid in the first chamber of the first diaphragm pump and the pressure of the hydraulic fluid in the first chamber of the second diaphragm pump;

(e3) using the second hydraulic fluid source to adjust the pressure of the hydraulic fluid in the first chamber of the first diaphragm pump such that it has a second equivalent pressure to the pressure of the hydraulic fluid in the first chamber of the second diaphragm pump; and (f) ceasing pumping of the hydraulic fluid from the first hydraulic fluid source to the first chamber of the second diaphragm pump, wherein the materials have different viscosities, and wherein the first equivalent pressure and second equivalent pressure are different such that the materials are delivered at the flow rate.

10. The method as recited by claim 9 which additionally includes the step of: (g) repeating steps (c) to (f) one or more times.

11. A pumping system for delivering a plurality of different pumpable materials serially at a flow rate to a packaging machine, wherein the system comprises:

a plurality of diaphragm pumps, wherein each diaphragm pump has a first chamber for receiving a hydraulic fluid from a first and/or a second hydraulic fluid source and a second chamber for receiving a material to be pumped from one of a plurality of different pumpable material sources, and a sensor for detecting the pressure of the hydraulic fluid in each of the first chambers of the plurality of diaphragm pumps, which sensor is operably connected to the first and/or second hydraulic fluid source such that the sensor can activate the first and/or second hydraulic fluid source to ensure that the hydraulic fluid in each of the first chambers of the plurality of diaphragm pumps have equivalent pressures at a time when delivery from one of the diaphragm pumps ceases and delivery from another commences, and a controller that is configured to receive a signal from the packaging machine at a time when delivery from one of the diaphragm pumps is to cease and delivery from another of the diaphragm pumps is to commence, and, in response to that signal, causes the system to switch from delivery of the pumpable material from one of the diaphragm pumps to delivery of the pumpable material from another of the diaphragm pumps, wherein the different pumpable materials have different viscosities and wherein the equivalent pressures are different such that the materials are delivered at the flow rate.

12. The system as recited by claim 11 wherein the first and/or second hydraulic fluid source is a hydraulic fluid pump connected to a supply of hydraulic fluid.

13. The system as recited by claim 11 wherein the first and second hydraulic fluid sources comprise a first and second hydraulic fluid pumps each of which is each connected to a supply of hydraulic fluid.

14. The system as recited by claim 11 wherein the first chamber of each diaphragm pump has a hydraulic fluid drain which is connected to a supply of hydraulic fluid.

15. The system as recited by claim 11 wherein the first and second chamber of each diaphragm pump is divided by a moveable diaphragm.

16. The system as recited by claim 11 which has two diaphragm pumps, and two pumpable material sources, wherein each diaphragm pump is connected in use to a respective one of the pumpable material sources.

17. The system as recited by claim 11 which is arranged to operate continuously.

18. A method of delivering a plurality of different materials at a flow rate to a packaging machine, which method comprises:

(a) providing a pumping system having:

(a1) a plurality of diaphragm pumps, wherein each diaphragm pump has a first chamber for receiving a hydraulic fluid from a first or a second hydraulic fluid source, a second chamber for receiving a material to be pumped from a plurality of pumpable material sources; and (a2) a controller that is configured to receive signals generated by the packaging machine, each signal being generated by the packaging machine at a time when delivery from one of the diaphragm pumps is to cease and delivery from another of the diaphragm pumps is to commence;

(b) filling a second chamber of a first diaphragm pump with a first of the pumpable materials from a first of the pumpable material sources;

(c) pumping hydraulic fluid from the first hydraulic fluid source to the first chamber of the first diaphragm pump so that the pumping system provides the first pumpable material at the flow rate, while:

(c1) filling the second chamber of a second diaphragm pump with a second of the pumpable materials from a second of the pumpable material sources;

(c2) sensing a pressure of the hydraulic fluid in the first chamber of the first diaphragm pump and a pressure of the hydraulic fluid in the first chamber of the second diaphragm pump;

(c3) using the second hydraulic fluid source to adjust the pressure of the hydraulic fluid in the first chamber of the second diaphragm pump such that it has a first equivalent pressure to the pressure of the hydraulic fluid in the first chamber of the first diaphragm pump;

(d) stopping pumping of the hydraulic fluid from the first hydraulic fluid source to the first chamber of the first diaphragm pump;

(e) pumping hydraulic fluid from the first hydraulic fluid source to the first chamber of the second diaphragm pump so that the system provides the second pumpable material at the flow rate, while:

(e1) filling the second chamber of the first diaphragm pump with the first pumpable material from the first pumpable material source;

(e2) sensing the pressure of the hydraulic fluid in the first chamber of the first diaphragm pump and the pressure of the hydraulic fluid in the first chamber of the second diaphragm pump;

(e3) using the second hydraulic fluid source to adjust the pressure of the hydraulic fluid in the first chamber of the first diaphragm pump such that it has a second equivalent pressure to the pressure of the hydraulic fluid in the first chamber of the second diaphragm pump; and (f) ceasing pumping of the hydraulic fluid from the first hydraulic fluid source to the first chamber of the second diaphragm pump, wherein the materials have different viscosities, and wherein the first equivalent pressure and second equivalent pressure are different such that the material are delivered at the flow rate, and wherein upon receipt of one of the signals from the packaging machine, the controller causes the pumping system to effect step (e) subsequent to step (d) in order to switch delivery of the pumpable material from one of the diaphragm pumps to delivery of the pumpable material from another of the diaphragm pumps.

19. The method as recited by claim 18 which additionally includes the step of:

(g) repeating steps (c) to (f) one or more times.

* * * * *